US005118950A

United States Patent [19]

Bahns et al.

[11] Patent Number: 5,118,950

[45] Date of Patent: Jun. 2, 1992

[54] CLUSTER ION SYNTHESIS AND CONFINEMENT IN HYBRID ION TRAP ARRAYS

[75] Inventors: John T. Bahns, DeWitt; William C. Stwalley, Iowa City, both of Iowa

[73] Assignee: The United States of America as represented by the Secretary of the Air Force, Washington, D.C.

[21] Appl. No.: 459,017

[22] Filed: Dec. 29, 1989

[51] Int. Cl.[5] ..... H01J 27/00

[52] U.S. Cl. ..... 250/424; 250/423 R; 376/106; 376/120; 376/127; 376/130; 376/913

[58] Field of Search ..... 250/424, 423 R; 376/106, 107, 108, 109, 110, 111, 114, 115, 116, 117, 120, 127, 151, 130, 913; 149/1

[56] References Cited

U.S. PATENT DOCUMENTS

| | | | |
|---|---|---|---|
| 2,939,952 | 6/1960 | Paul et al. | 250/41.9 |
| 3,274,435 | 9/1966 | Kerst | 376/120 |
| 3,402,358 | 9/1968 | Wharton | 250/251 |
| 3,532,879 | 10/1970 | Braunstein et al. | 250/251 |
| 3,710,279 | 1/1973 | Ashkin | 250/251 |
| 3,808,432 | 4/1974 | Ashkin | 250/251 |
| 3,808,550 | 4/1974 | Ashkin | 250/251 |
| 4,175,234 | 11/1979 | Hunt et al. | 250/423 R |
| 4,540,884 | 9/1985 | Stafford et al. | 250/282 |
| 4,563,579 | 1/1986 | Kellerhals et al. | 250/291 |
| 4,867,939 | 9/1989 | Deutch | 376/913 |

OTHER PUBLICATIONS

Andreas Wolf "Antihydrogen" pp. 1-6, Cern-EP/-86-179 Nov. 12, 1986.

*Primary Examiner*—Jack I. Berman
*Assistant Examiner*—Kiet T. Nguyen
*Attorney, Agent, or Firm*—William Stephanishen; Donald J. Singer

[57] ABSTRACT

A cluster ion synthesis process utilizing a containerless environment to grow in a succession of steps cluster ions of large mass and well defined distribution. The cluster ion growth proceeds in a continuous manner in a plurality of growth chambers which have virtually unlimited storage times and capacities.

10 Claims, 1 Drawing Sheet

CLUSTER ION SYNTHESIS AND CONFINEMENT IN HYBRID ION TRAP ARRAYS

STATEMENT OF GOVERNMENT INTEREST

The invention described herein may be manufactured and used by or for the Government for governmental purposes without the payment of any royalty thereon.

BACKGROUND OF THE INVENTION

The present invention relates broadly to a cluster ion synthesis, and in particular to the method and apparatus for the synthesis of large ion clusters.

The state of the art of cluster ion production is well represented and alleviated to some degree by the prior art apparatus and approaches which are contained in the following U.S. Patents:

U.S. Pat. No. 2,939,952 issued to Paul et al on Jun. 7, 1960;

U.S. Pat. No. 4,540,884 issued to Stafford et al on Sept. 10, 1985; and

U.S. Pat. No. 4,563,579 issued to Kellerhals et al on Jan. 7, 1986.

The Paul et al patent describes an apparatus for separating charged particles of different specific charges.

The Stafford et al patent is directed to a method of mass analyzing ion samples by use of a quadrupole ion trap. Improved mass selection is achieved in a quadrupole ion trap or ion trap type mass spectrometer by simultaneously trapping ions within the mass range of interest and then scanning the applied RF and DC voltages or the frequency to sequentially render unstable trapped ions of consecutive specific masses.

The Kellerhals et al patent discloses a procedure for recording ion-cyclotron resonance spectra and the apparatus for carrying out the procedure.

An article in Aviation Week and Space Technology, Mar. 21, 1988 on pages 19 and 20, by William B. Scott describes the use of antimatter as a propellant which could be in use by the early 21st century.

The present invention satisfies a need in the prior art to provide a process which will surmount most of the problems that are associated with antimatter storage for space related applications or energy storage. The main problems result from the very nature of antimatter, i.e. positrons and antiprotons, and the form it is in following production of such antimatter as subatomic particles. Antimatter cannot be allowed to come into contact with normal matter. It must also be stored in a form such that it is tightly bound within the container and can be safely stored for very long times. The form of storage must be able to withstand at least moderate acceleration during transport. It must also be in a high density (energy/volume and energy/mass) form of container, so that large container volumes and masses are avoided. The subatomic particles must be efficiently collected and assembled (approaching bulk matter) without excessive expenditure of energy. These stringent requirements can be simultaneously satisfied by the successful application of the present cluster ion synthesis process.

SUMMARY OF THE INVENTION

The present invention is a process by which cluster ions may be grown and confined in a containerless environment. The ion clusters are synthesized inside growth chambers which comprise donut-shaped ion traps which include end caps at the input and output of the trap. The end caps include a transfer port. Nascent cluster ions that are produced within these traps via ion-molecule reactions or ion-ion reactions have a larger mass than the parent (reactant) cluster ions. These newly formed cluster ions are transferred to other traps for which they are resonant (and hence strongly bound) before undergoing further growth via an appropriate growth cycle. By this means, a sequence or array of traps is used in succession to produce cluster ions of large mass and well defined size distribution. The synthesis proceeds in a nearly continuous manner without significant loss of cluster ions since the traps that confine them have virtually unlimited storage times for resonant or nearly resonant ions.

It is one object of the present invention, therefore, to provide an improved cluster ion synthesis process.

It is another object of the invention to provide an improved cluster ion synthesis process that utilizes multiple ion traps as a containerless storage vehicle.

It is an even further object of the invention to provide an improved cluster ion synthesis process wherein the storage containers have large trap depths.

It is yet another object of the invention to provide an improved cluster ion synthesis process wherein all reactions in the growth cycles are exothermic.

It is still another object of the invention to provide an improved cluster ion synthesis process wherein the reactions proceed with very large rate constants.

It is a further object of the invention to provide an improved cluster ion synthesis process wherein the potential energy density is extraordinarily high.

It is another object of the invention to provide an improved cluster ion synthesis process that operates with low losses and high production efficiency.

It is still a further object of the invention to provide an improved cluster ion synthesis process that utilizes low production (and storage) energy requirements.

It is yet another object of the invention to provide an improved cluster ion synthesis process that integrates production with storage.

It is still another object of the invention to provide an improved cluster ion synthesis process wherein the internal energy of nascent cluster ions can be radiated by spontaneous emission.

It is yet a further object of the invention to provide an improved cluster ion synthesis process wherein there is no need to operate at near zero K temperatures except to maintain low pressure of normal matter background gas.

It is an even further object of the invention to provide an improved cluster ion synthesis process with enhanced growth rates and efficiency as the cluster ion size increases.

These and other advantages, objects and features of the invention will become more apparent after considering the following description taken in conjunction with the illustrative embodiment in the accompanying drawings.

DESCRIPTION OF THE PREFERRED EMBODIMENT

Figure 1:
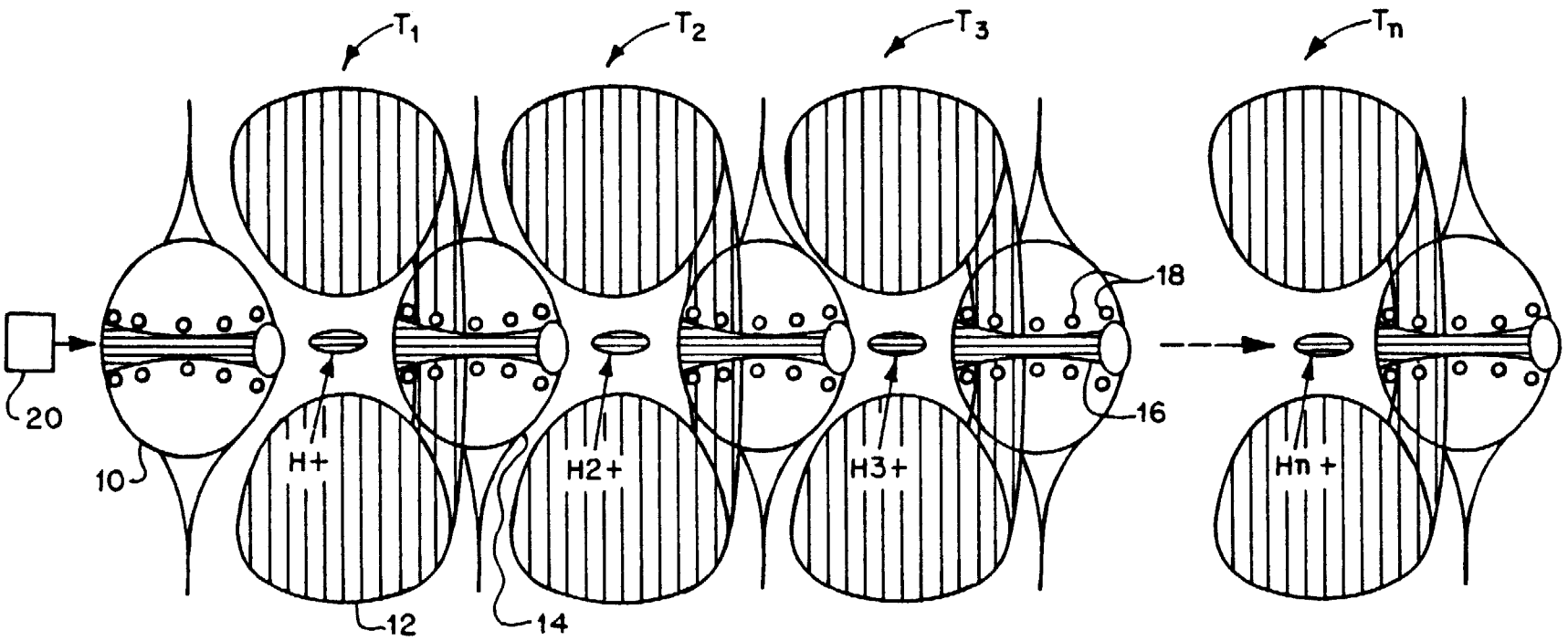
FIG. 1 is a schematic illustration of the cluster ion synthesis process.

Referring now to FIG. 1, there is shown a schematic illustration of the cluster ion synthesis and confinement apparatus. The synthesis of the cluster ions is achieved within the individual ion trap of a plurality of axially-aligned ion traps, $T_1$, $T_2$, $T_3$- - - $T_n$. An individual ion trap, $T_1$, is comprised of three components: a) a first end cap 10, a torroid of revolution 12, and a second end cap 14. The area within the boundary of these three components comprises the containerless environment in which the cluster ions are formed and grown. The end caps 10, 14 are identical in construction and purpose. The end caps 10, 14 comprise spheroids which have a transfer port 16 positioned therein. The end caps 10, 14 and the toroid of revolution 12 may be constructed of suitable conductive material. The end caps 10, 14 include coils 18 which are embedded with the end caps and surround the transfer port 16.

During the growth cycles of the cluster ion process, each of the ion trap containers $T_1$–$T_n$ would contain seed ions. A neutral gas 20 is introduced into the growth chamber of ion trap $T_1$ through the transfer port 16 of end cap 10. All end caps and ion traps will be held at some potential. An electric current is applied to the respective coils of the end caps to create a magnetic field in the transfer port when cluster ions are transferred from one trap to another. The growth cycle of the cluster ions may be maintained within a particular growth chamber until the determining factor or goal for that part of the process has been achieved. The ion growth synthesis process continues by transferring specified amounts of the cluster ions to the next growth chamber for additional processing.

When the process is applied to the problem of antimatter storage (for space propulsion or energy storage), the resulting advantages combine to make it a likely solution at a time when no competitive alternative seems to exist. It is the only way known by which antimatter may be concentrated while trapped in a containerless and nearly lossless environment. The advantage to this method is that it is the only one of its kind proposed that ensures long-term storage (with potentially high energy density) of antimatter in stable traps that can also be light compact, and economical to use. That is, these advantages do not exist without the ability to synthesize large cluster ions (enabled by the proposed process). Without the process, ion traps (with their many advantages in this regard) are useless for the storage of significant amounts of energy (or energy density). It is the incorporation of cluster ion synthesis with ion traps that results in a highly desirable antimatter production and storage system. Once large seed ion clusters are produced, the condensation process becomes easier since the rate (and efficiency) of the proposed process increases due to the far larger cross sections for the association reactions.

Ion traps provide deep potential minima for the containerless confinement of matter or antimatter. They provide dynamic storage of the trapped ions, which is also an advantage since this actually decreases the probability of accidental annihilation of stored antimatter due to collisions with background gas. It should be noted that cryogenic temperatures will probably be required to insure that the background gas pressure can be reduced to negligible pressures for antimatter storage. They allow the possibility of optical side-band cooling for the control of trapped ions of any size or complexity. This feature is not available with other methods (without this possibility of cooling, other schemes are virtually useless). In addition they allow for the cooling of translational degrees of freedom via synchrotron radiation. Ion traps also require very little energy to operate, may be made compact, and be constructed of light weight materials.

This process for cluster ion synthesis is the only means known by which ion traps may be utilized for significant antimatter storage. All of the primary reactions involved proceed with rate coefficients which are among the highest encountered in gas phase kinetics. All of the reactions proceed exothermically, and the excess energy in the nascent cluster ions (in all but the lower 22 reactions of the sequence) can escape by spontaneous radiation. Cluster ions are easy to control with the application of electric and magnetic fields making them an ideal form for storage since the means of moving them to and from storage also becomes relatively easy.

If the process utilizes normal matter, the advantages are not as numerous. The primary advantage comes from the ability to synthesize and confine cluster ions in an ideal container (protecting the integrity of the contents) for long times. Also, cluster ions of very large sizes could be produced with very narrow, well defined size distributions. Ion traps are currently used for the confinement of small quantities of ions for frequency standard research. The coupling of many ion traps into arrays would enable storage on a much larger scale. This would be an advantage since low volume storage with just a few traps constitutes such a small quantity, that less sensitive research techniques (diagnostics) cannot be used.

The present invention as described herein utilizes a process whereby clusters of ions may be synthesized and confined in potentially large quantities within a containerless environment. The cluster ion growth process comprises a plurality of generalized growth cycles that take place within growth chambers of modified ion traps. These growth chambers essentially comprise a set of ion traps which have been arranged to form a container. Each individual ion trap of the set, includes two transfer ports which facilitate the passage of ions into and out of the trap's growth chamber. An example of one such growth cycle utilizing ion-molecule association reactions is given by the following example:

$$M_n^{\pm q} + M = M_{n+1}^{\pm q} \quad (1)$$

whereby an ion cluster of element M consisting of n atoms and charge $\pm q$ may be transformed into the next higher n-mer ion ($M_{n+1}^{\pm q}$). Other growth cycles may also be used, such ion-ion association reactions that produce larger ions. For example, $$M_{n+}^{aq} + M_m^{-bq} = M_{n+m}(a-b)q \quad (2)$$

such that $(a-b) \neq 0$ resulting in the production of larger sized, charged clusters. The above two examples are for the synthesis and storage of homogeneous cluster ions (i.e., those composed entirely of element M) although the analogous reactions to produce heterogeneous (or compound) cluster ions is also included such as, $$M_n^{\pm q} + N = M_n N^{\pm q} \quad (3)$$

or $$M_n^{+aq} + N_m^{-bq} = M_n N_m (a-b)q \text{ with } (a-b) \neq 8 \quad (4)$$

as possible two body (or second order) reactions that can be used. Furthermore, the analogous three body (or third order) reactions may also be used such as, $$M_n^{\pm q} + h\nu_1 + M = M_{n+1}^{\pm q} h\nu_2 \quad (5)$$

may also be used where a photon or other suitable particle may play the role of the third body.

In more general terms, the cluster ion growth process provides for the synthesis and confinement of cluster ions of potentially large sizes approaching the bulk limit and starting from subatomic particles, if necessary. It allows one to collect, condense, assemble, and store large collections of normal or exotic (e.g. antimatter) matter in the form of cluster ions. In practice, the process would rely upon the manipulation of neutral atoms as well as ions, e.g. by lasers and electromagnetic fields, respectively.

In FIG. 1 is shown an illustration of the cluster ion synthesis apparatus as applied to an example problem of antimatter storage. First, neutral antihydrogen is produced in any suitable commercially available ion trap, such as any of the currently well-known Paul or Penning ion traps, that combines antiprotons and positrons. The produced neutral antihydrogen may be guided by laser beam to trap $T_1$ where the neutral gas undergoes ion-molecule association to produce anti-$H_2^-$ (the counterpart of normal $H_2^+$) which is subsequently transferred to trap $T_2$. The further addition of neutral antihydrogen to this trap produces anti-$H_3^-$ which is ejected transferred to trap 3 and so on in order to ultimately produce cluster ions of appreciable size. After ions of appreciable size are produced they may be added to each other in ion-ion association reactions (also within specially prepared traps) to produce still larger cluster ions (see eqns. 2 and 4 above). It is important to note that FIG. 1 is an illustration of the process and does not encompass all the potential variations. The actual implementation has considerable flexibility. For example, it may turn out to be more expedient to add ejected cluster ions to traps containing antiprotons (or positrons). Although many variations on the process exist, the main features of the process as outlined above remain.

One application of this process would be in the area of advanced propulsion. At the present time there are no other schemes known by which antimatter may be efficiently condensed from subatomic particles into potentially high energy density form in significant quantities suitable for use as a high specific impulse and thrust propellant for space missions. The antiprotons and positrons from nuclear reactors could be collected (after cooling) and grown (within ion traps) into large cluster ions. The storage of antihydrogen in this form would be particularly useful and convenient as an energy source or as a propellant with unsurpassed characteristics (such as energy density, specific impulse, thrust, and mass ratio).

A second application is in the semiconductor field. Ion clusters of well known composition could be produced and used to implant or dope various substrates such as silicon, germanium, etc., to produce new semiconductor materials with unique properties.

A third application might be in the branch of Chemistry dealing with surface or gas phase catalyzed reactions. This would involve use of the process in some phase of the manufacture, storage, or basic research into specific clusters in terms of their properties as catalysts (size, reactivity etc.).

A fourth application is in "cold" nuclear fusion. These devices may be useful in producing cluster ions that could be used as projectiles for high energy collisions with solid targets of hydrogen or other light elements (or isotopes).

The design of traps for large cluster ions would make them applicable to the confinement of other types of large molecules for other fields of research (such as the synthesis and confinement of polymer or nucleic acid ions).

As mentioned previously, the application of the process is not limited to the use of hydrogen, clusters of antimatter, or homogeneous clusters of normal atoms and that it also incorporates flexibility in the selection of reactions (e.g. ion-molecule, ion-ion, etc.). Flexibilities may also exist in the further design and refinement of the multiple ion traps which are used as growth chambers. Some of these trap flexibilities are as follows:

1. New geometries (1, 2 and 3 dimensional arrays).
2. New electrode configurations and shapes.
3. The development of mini and micro-traps.
4. Computer control.
5. Deformable surfaces.
6. New electric and magnetic field geometries.

The synthesis process offers a number of features that make it novel and useful. It utilizes multiple ion trap arrays for the efficient synthesis, confinement, and storage of antimatter cluster ions. It is also compatible with and relies upon the use of laser beams for the manipulations of reactants (and reactions). Lasers may be used to cool and focus neutral atoms or monatomic ions with at least one valence electron, as well as provide photons as a third body in the first few reactions of the growth cycle. Reactions beyond the first few may proceed via second order kinetics and hence do not require laser manipulation.

Although the invention has been described with reference to a particular embodiment, it will be understood to those skilled in the art that the invention is capable of a variety of alternative embodiments within the spirit and scope of the appended claims.

What is claimed is:

1. A method of producing cluster ions which comprises:
   a) generating a neutral gas,
   b) introducing said neutral gas into a first container which contains a first cluster ion of n nuclei ($n \geqq 1$), said neutral gas reacting with first cluster ion to form a second larger cluster ion,
   c) transferring said second cluster ion to a second container,
   d) reacting said neutral gas with said second cluster ion to form a third larger cluster ion,
   e) transferring said third cluster ion to a third container, said transferring and reacting steps are repeated a plurality of times to produce cluster ions of a specific size and energy.

2. A method of producing cluster ions as described in claim 1 wherein said reacting steps comprise ion-ion association reactions.

3. A method of producing cluster ions as described in claim 1 wherein said reacting steps comprise ion-molecule reactions.

4. A method of producing cluster ions as described in claim 1 wherein said neutral gas comprises a neutral antihydrogen gas.

5. A method of producing cluster ions as described in claim 1 wherein said first cluster ion is a monatomic ion wit at least one valence electron.

6. A method of producing cluster ions as described in claim 1 wherein said reacting steps utilize the high rate coefficients encountered in gas phase kinetics.

7. A method of producing cluster ions as described in claim 1 wherein said reacting steps are exothermic.

8. A method of producing cluster ions as described in claim 1 wherein said neutral gas are manipulated by lasers.

9. A method of producing cluster ions as described in claim 1 wherein said reacting steps after the first reacting step proceed via second order kinetics and do not require laser manipulation.

10. A method of producing cluster ions as described in claim 8 wherein said neutral gas are manipulated by electromagnetic fields.

* * * * *